United States Patent [19]

Peters

[11] 4,304,082

[45] Dec. 8, 1981

[54] PROTECTIVE SCREEN FOR IMPROVING THE FIRE RESISTANCE OF BUILDING STRUCTURES

[76] Inventor: Lyle Peters, 11273 Hanover Rd., Cincinnati, Ohio 45240

[21] Appl. No.: 132,376

[22] Filed: Mar. 21, 1980

Related U.S. Application Data

[63] Continuation-in-part of Ser. No. 21,307, Mar. 16, 1979.

[51] Int. Cl.[3] ..... F28F 13/00; E04B 1/94

[52] U.S. Cl. ..... 52/507; 52/202; 52/508; 165/135; 428/920

[58] Field of Search ..... 52/507, 508, 515, 202; 126/65, 66, 67, 141; 109/84, 85, 82; 250/517; 165/135, 136, DIG. 4, DIG. 6; 428/920

[56] References Cited

U.S. PATENT DOCUMENTS

| | | | |
|---|---|---|---|
| 3,517,627 | 6/1970 | Kruse | 52/515 |
| 3,874,362 | 4/1975 | Kapustin | 126/67 |
| 4,206,742 | 6/1980 | Johnson | 126/66 |

OTHER PUBLICATIONS

Architectural File of Sweet's Catalog, TH455 19a/cha, 7 pp. of spec. 1956.

*Primary Examiner*—John E. Murtagh
*Attorney, Agent, or Firm*—Frost & Jacobs

[57] ABSTRACT

A protective screen for reducing heat transmitted from a fuel burning stove or the like to an adjacent structural wall surface. The protective screen includes a supporting frame enclosing an area corresponding to the area of the wall surface to be protected. The frame supports a mesh-like screen constructed of high purity copper or the like which permits the free passage of ventilating air therethrough but retards to a relatively great extent the transfer of heat of relatively high temperatures associated with the stove to the adjoining wall surface. The frame is supported in spaced parallel relationship with the adjacent wall by means of a plurality of tubular spacing members in order to provide an air space between the screen material and the adjoining wall. The protective screen eliminates fire hazards when the fuel burning stove is placed close to the adjoining wall.

5 Claims, 8 Drawing Figures

PROTECTIVE SCREEN FOR IMPROVING THE FIRE RESISTANCE OF BUILDING STRUCTURES

SUMMARY OF THE INVENTION

This application is a continuation-in-part of pending application Ser. No. 21,307, filed Mar. 16, 1979, entitled Building Structures Having Improved Fire Resistant Properties.

Various methods of construction have been proposed for increasing the fire resistance rating of structural components used in commercial and residential structures in order to retard the spread of fire and prevent collapse of structural members which might otherwise be weakened by prolonged exposure to elevated temperatures caused by fire or flame. Such fire resistance procedures are necessary not only in structures employing wood or other flammable support members, but also in buildings using materials which might otherwise be considered non-flammable, such as steel beams and the like. In this latter situation, prolonged exposure to elevated temperatures may cause actual melting or sagging of the beam. Alternatively, in many cases the hot metallic beam has been found to shatter when rapidly cooled by water being sprayed on the fire.

Attempts have been made to insulate such structural members against high temperatures by covering them with various types of solid non-heat conducting materials such as asbestos or concrete. Such attempts have not proven entirely successful, however, since the condition of the structural member cannot be ascertained by simply visual inspection. Consequently, moisture trapped inside the air impervious coating may cause deterioration of the structural member which cannot be detected until failure occurs. In addition, fire fighters often have the need to quickly determine the condition of a supporting member during a working fire in order to guard against unexpected collapse of walls and ceilings. Since the types of fire resistant coatings presently used generally do not deteriorate to any great extent under the effects of high temperatures, the condition of the underlying member cannot be visually determined. In addition, concrete or other masonry type protective coatings add significant weight to the structural members.

Problems with improving the fire resistance of structures have also arisen in situations where older buildings are being converted to multiple tenant use, for example. In this situation, existing fire codes generally require the erection of fire resistant walls between adjacent dwelling units. Often masonry or block construction is the only practical way to obtain the necessary fire resistance. However, existing structures are often unable to support the increased load presented by such masonry walls so that resort must be made to less safe and effective methods. This same problem occurs in situations where high fire incidence areas such as kitchens, furnace rooms, etc. are located near public gathering places. In this case, it is difficult to add effective fire resistant walls to the existing structure.

Another important area of concern is providing the free flow of ventilating air between adjoining or interconnected areas while effectively and automatically preventing the spread of fire through the ventilating passageways. Conventional building construction generally calls for adjoining areas to be segregated to the degree necessary to prevent vertical and horizontal spread of fire, in order to contain the fire as much as possible. Unfortunately, this so-called "containment" theory of fire control has lead to additional problems. In particular, incomplete combustion caused by lack of ventilating air and incomplete oxidation of burning materials produce large quantities of monotonic gases such as carbon monoxide, and other forms of smoke, which often present a greater personal danger than the flames themselves. In addition, burning materials in a closed area may produce pressure buildups which result in sudden explosive collapses of walls and ceilings, increasing the danger to persons in the area and further spreading the fire.

The need to prevent vertical spread of fires through hollow wall spaces is reflected in conventional building techniques utilizing balloon and platform framing. For example, in balloon framing, a piece of wood stud is wedged between the stud spaces at intervals in all walls and vertical chases to slow the spread of fire and decrease the supply of air necessary for efficient oxidation. Likewise, in platform framing, the top and bottom plates effectively act as fire stops. Furthermore, wall coverings may be constructed of fire resistant materials such as gypsum board in order to resist the passage of fire for certain periods of time.

In some situations, however, it is necessary and desirable to provide for the free flow of ventilating air between adjoining spaces. For example, in attic areas ventilation may be necessary to prevent unwanted condensation. In some types of construction, a ventilating passageway is purposely designed within exterior and interior walls in order to surround the entire structure in an envelope of moving air. It has been found that when the air in the envelope is heated, the heating requirements for the overall structure are considerably reduced. This technique is impossible with present fire codes which are specifically designed to prevent the free circulation of air between the walls and around the structure.

There has also been a long felt need for reliable and effective means for insulating interior walls and other structures from the heating effects of free-standing fireplaces or wood stoves. This problem has become even more acute with the recent increase in popularity of such devices for providing supplemental and energy conserving residential heating. Generally, fire codes require that such heating appliances be positioned no closer than 36 inches from an adjoining wall surface in order to eliminate the amount of heat transferred to the wall. In many rooms, this is a physical impossibility, preventing the effective use of such supplemental heat sources. It has been suggested that the inner surface of the adjoining wall be covered with a heat insulating material such as asbestos to prevent over heating of the wall and a possible fire hazard. However, even with such insulating means, the heating device must still generally be positioned no less than 18 inches from the wall surface. Furthermore, such insulating means are generally unattractive and difficult to secure to the wall.

The present invention seeks to overcome many of the problems associated with prior art attempts to provide effective fire resistance and protection. Fundamentally, the invention envisions the use of a metallic mesh material of high heat conductivity which can be attached to metallic or nonmetallic structural building members to effectively dissipate the high temperatures required for ignition of the structural member. For example, it has been found that two layers of mesh constructed of strands of high purity copper wire having varying thicknesses from 0.015 inches to 0.018 inches with 20–22 strands per inch provides excellent fire protection for wood and metal beam structural members, by reducing temperatures at the structural member surface by eighty percent (80%). In the case of a metallic beam, the mesh material is attached to both sides of the interior web or flange by welding or soldering. A second portion of the mesh material is then wrapped completely around the outside of the beam to complete the fire protective covering. A similar arrangement may be used with wood members. This arrangement permits ventilating air to prevent the problems described hereinabove, dissipates ignition temperatures, and also permits rapid visual inspection of the structural integrity of the supporting member.

In the case of fire stops or barriers in existing or new structures, the mesh material can be utilized with wood frame dividing walls, for example, in many cases increasing the fire resistance to that presently obtainable with masonry and block construction. The mesh material may also be included in any hole, gap or chase which may provide a passageway to spread fire in order to effectively retard the passage of flame. The material also acts to slow the spread of fire by direct burn, and prevents hot gases, particularly those near the ignition temperature, from spreading from one area to another. At the same time, however, the free passage of ventilating air is permitted in order to insure more efficient oxidation of the burning material as well as relieve any pressure buildup which may occur in a given closed area. Since with this type of construction, the requirement for air impervious fire stops is eliminated, the type of air curtain construction contemplated hereinabove can be readily obtained with the resulting savings in energy and materials.

In another embodiment, the metallic mesh material forms a protective screen for reducing heat transmitted from a fuel burning stove or the like to an adjacent structural wall surface. The protective screen includes a supporting frame enclosing an area corresponding to the area of the wall surface to be protected. A mesh-like screen of the metallic mesh material is supported by the frame, the screen permitting the free passage of ventilating air therethrough but retarding to a relatively great extent the transfer of heat from the fuel burning stove to the wall surface. A plurality of spaced tubular spacing members is positioned between the rear surface of the frame and the adjoining wall to provide a clear air space between the screen material and the wall surface. The entire assembly is attached to the wall by means of threaded fasteners passing through the frame and spacing members.

Although the specific principle by which the present invention obtains its novel results is not fully understood, the result is the same as when water is used to extinguish fire or act as a curtain from burning material. Consequently, the high absorption and conduction characteristics of water and the present invention dissipate the high temperatures below the ignition level of the material being protected. Further details of the invention will become apparent in the description which follows.

DETAILED DESCRIPTION

Figure 1:
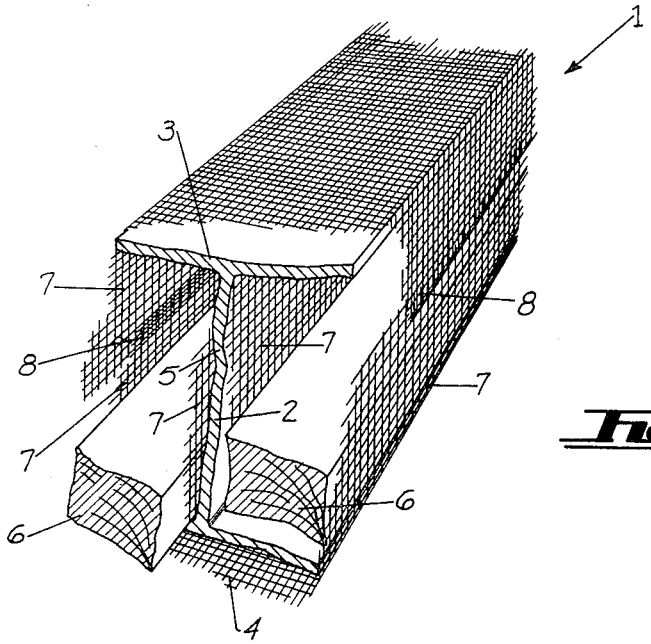
FIG. 1 is a fragmentary cutaway perspective view, partially in cross section, illustrating a typical I-beam having improved fire resistant properties.

FIG. 1 illustrates a typical structural I-beam member, shown generally at 1, utilizing the improved fire resistant properties of the present invention. A metallic beam 2 having an upper horizontal web section 3 and a spaced parallel lower horizontal web section 4 are joined at their approximate midpoints by vertical flange or web 5. As is well known in the art, wood blocking 6 may be used in order to secure wood framing members and finish materials (not shown) to the supporting beam.

In order to improve the fire resistance characteristics of beam 2, one or more layers of metallic screen-like mesh 7 is attached, such as by welding, brazing, etc., to the outer surfaces of vertical flange member 5. In general, the layers of metallic material will extend uninterruptedly between the innermost surfaces of flanges 3 and 4. In a preferred embodiment, the mesh-like material 7 will be constructed of metallic material of high purity having a relatively high heat conductivity (K), where K is expressed in cal-cm-sec/cm$^{2}$-° C. For this purpose, it has been found that copper (K=0.95 for 99.9+% purity), aluminum (K=0.53) or silver (K=1.0 for sterling silver) provide excellent results. Other materials having lower thermal conductivities may also be used with less efficient results, such as brass (K=0.3 for 70% Cu 30% Zn), bronze (K=0.2 for 95% Cu 5% Sn), iron (K=0.18 for 99.9+% purity), platinum (K=0.17), or various grades of steel (K=0.12 for 1020, K=0.115 for 1040, K=0.11 for 1080, K=0.035 for 18Cr8Ni stainless). In general, the preferred materials will have a thermal conductivity of K=0.18 or greater. In any event, low thermal conductivity fireproofing materials traditionally considered such as concrete (K=0.0025) and asbestos (K=0.0005), will not be used in the present invention.

In general, mesh 7 will be formed from strands of wire of various thicknesses of about 0.015 inches to 0.018 inches, with varying numbers of strands per inch of about 20–22. It has been found that high temperatures will cause a very fine mesh to break, thereby permitting the heat to pass directly to support member 2. On the other hand, if the mesh is made too coarse, insufficient temperature conduction is present for proper fire protection.

The fire protection of beam 2 may be completed by wrapping additional pieces of screen-like mesh 7 completely around the beam. As shown in FIG. 1, one piece of mesh 7 has been used to cover the upper half of beam 2, and a second piece of mesh used to cover the lower portion of the beam. The longitudinal edges of the two pieces of mesh may be joined as at 8 by soldering or the like. It will be understood that while for purposes of an exemplary showing, the metallic mesh has been described and illustrated as covering portions of a metallic I-beam, other structural supports, both metallic and nonmetallic, may be protected in the same manner. It has been found that two layers of such material placed on such a structural member will reduce the actual temperature of the surface of the support member by approximately eighty percent (80%), thereby increasing its fire resistance. The screen-like construction of the mesh also permits ventilating air to reach the surface of the support member 2 as described hereinabove.

Figure 2:
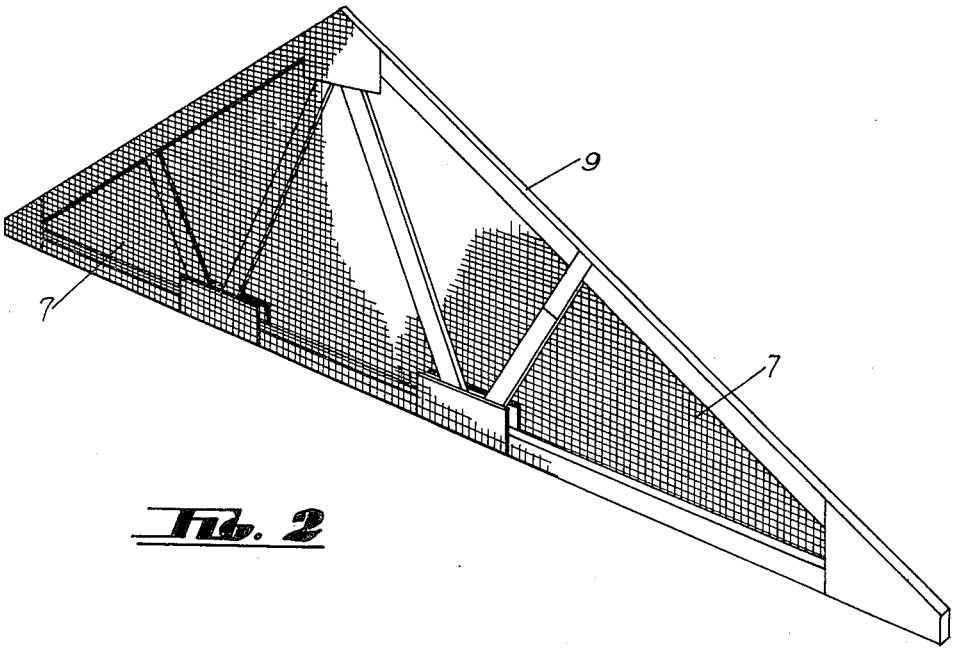
FIG. 2 is a cutaway perspective view of a typical truss having improved fire resistant properties.

FIG. 2 illustrates the use of metal mesh 7 with a typical structural support truss member 9. In this application, mesh 7 is secured to one or both sides of the truss members forming truss 9 in order to provide an air permeable surface for proper ventilation in an attic area, for example. However, the heat conducting properties of mesh 7 effectively serve to prevent the spread of fire or flame from one side of the truss section to the other, thereby producing an effective fire stop.

Figure 3:
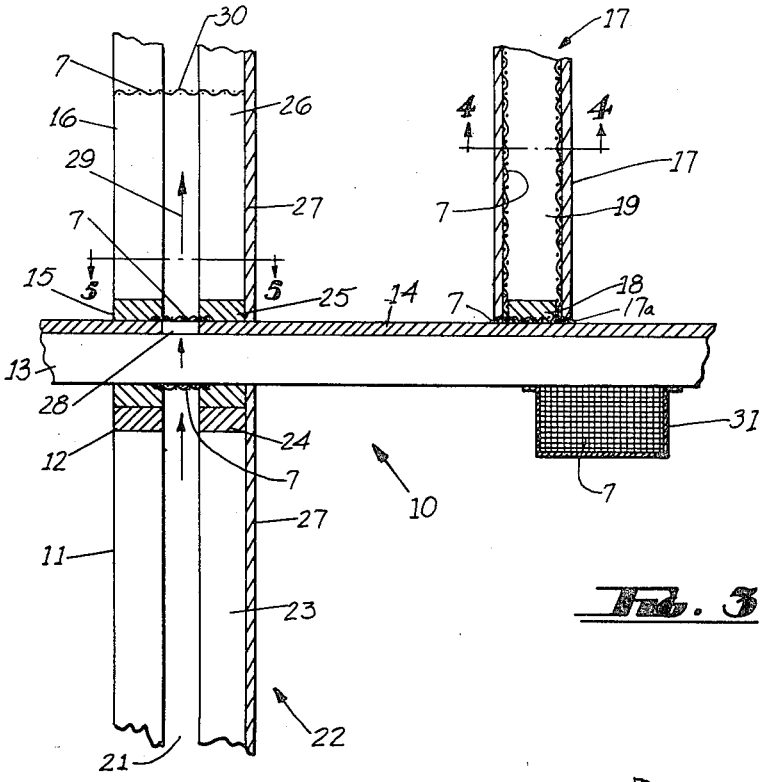
FIG. 3 is a fragmentary cross sectional view of an air curtain and interior wall construction having improved fire resistant properties.

FIG. 3 illustrates the use of the metallic mesh in a typical balloon-framed structure, shown generally at 10. As is well known in the art, this construction utilizes spaced vertical studs 11 which support one or more horizontal wall plates 12. The upper surface of the wall plates support a plurality of spaced horizontally disposed lower joists 13 upon which the flooring or subflooring 14 is positioned. Additional floors may be added by positioning a sill plate 15 on top of flooring 14 overlying plates 12, and erecting a plurality of spaced vertical studs 16. Usually appropriate wall coverings will be attached to the inner and outer edges of studs 11.

Figure 4:
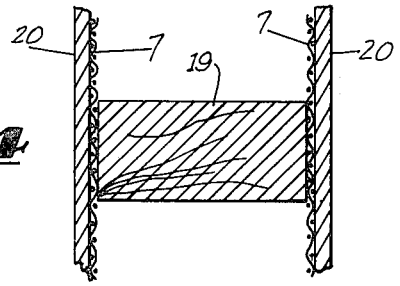
FIG. 4 is an enlarged fragmentary cross sectional view taken along section line 4—4 of FIG. 3.

Occasionally it becomes necessary in existing structures to add additional dividing partitions, such as that indicated generally at 17. As noted hereinabove, fire codes may necessitate the use of block or masonry construction, which older structures may be unable to support. However, the present invention permits the use of standard wood frame construction to form the necessary partition 17. As shown in FIG. 3 partition 17 comprises a horizontal plate 18 positioned atop flooring 14, which supports a plurality of spaced vertical studs 19. A layer of metallic mesh 7, previously described, may be attached to one or both sides of stud members 19 and at intermediate floor levels 17*a* as shown in more detail in FIG. 3 and FIG. 4. Suitable wall coverings, such as wallboard or the like 20, may be added overlying mesh 17 to complete the partition wall 17. Due to the relatively high thermal conductivity of mesh 17, the fire resistance of partition wall 17 is greatly increased with minimal increase in weight.

In some types of construction, a ventilating passageway, such as that shown at 21 in FIG. 3 is purposely designed within exterior and interior walls in order to surround the entire structure in an envelope of moving air. It has been found that when the air in the envelope is heated, the heating requirements for the overall structure are considerably reduced. In the present construction, a second interior wall, shown generally at 22 is constructed inwardly of the outer walls formed by studs 11 and 16. Inner wall 22 comprises a plurality of spaced vertical stud members 23 which support one or more horizontally disposed wall plates 24. It will be understood that wall plates 24 may or may not provide support for floor joists 13. A sill plate 25 similar to sill plate 15 may be positioned overlying flooring 14 and supports a plurality of spaced vertical stud members 26. Suitable wall covering, such as wallboard 27, may be attached to the innermost edges of studs 23 and 26, respectively.

Figure 5:
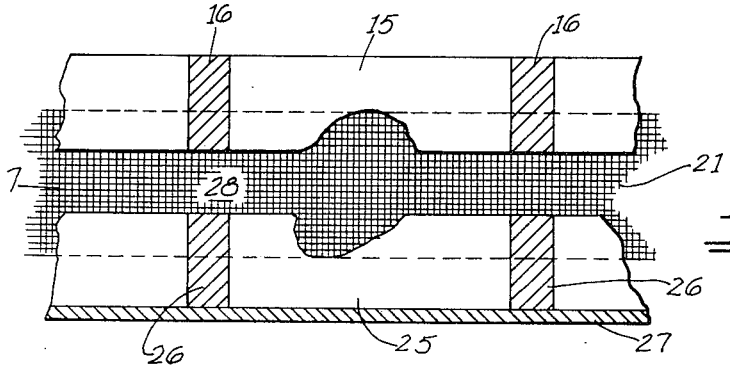
FIG. 5 is an enlarged fragmentary cutaway cross sectional view taken along section line 5—5 of FIG. 3.

Normally, the outermost edges of studs 23 and studs 26 will be spaced from the innermost edges of studs 11 and studs 16 to form an air passageway 21. A suitable opening 28 may be formed in flooring 14, as is best shown in FIG. 5 to provide the desired air envelope and ventilation. Consequently, air may be introduced at the lower end of passageway 21 by means not shown and directed upwardly as depicted by arrows 29, finally being exhausted at the upper portion of passageway 21, also by means not shown.

As noted hereinabove, conventional fire codes would prohibit such construction since the containment theory of fire protection requires fire stops between floors. However, the present invention provides effective fire stopping while at the same time permitting the free flow of ventilating air in passageway 21. This is accomplished by providing one or more layers of metallic mesh 7 as previously described at either or both of the upper and lower floor-adjoining ends of passageway 21. As shown in FIG. 5, mesh 7 extends completely across opening 28 and partially underlies sill plates 15 and 25, and is attached thereto by nailing, gluing or the like. It will be observed that in this construction, as in those previously described, nails may be driven through metallic mesh 7 without destroying its fire resistant properties. In addition, as shown in FIG. 3, other sections of mesh 7 may be included in additional areas of passageway 21 as required, such as that illustrated at 30.

It will be appreciated that this construction permits the free passage of air, while effectively retarding the passage of flame, fire, hot gases and the like. Furthermore, the ventilating characteristics permit effective oxidation of burning materials to eliminate noxious gases, and prevent pressure buildups to forestall explosive forces in contained areas.

Figure 6:
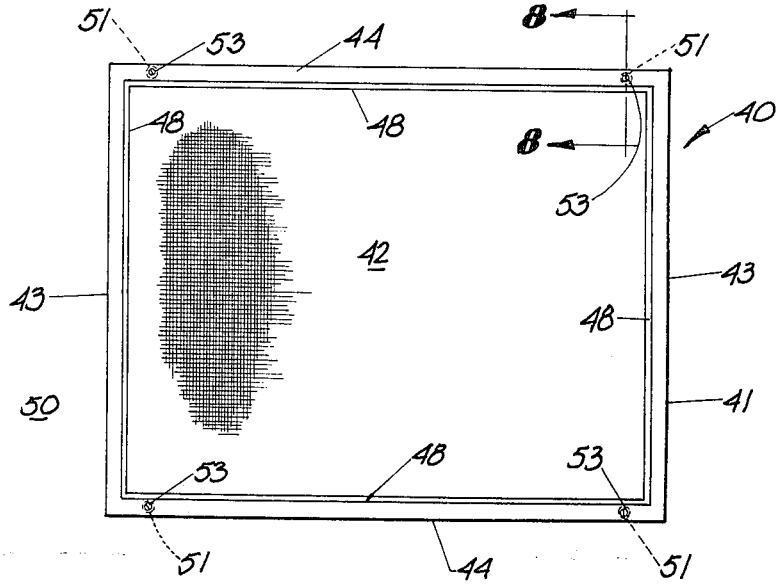
FIG. 6 is a front elevation view of a protective screen employing the inventive principles of the present invention.
Figure 7:
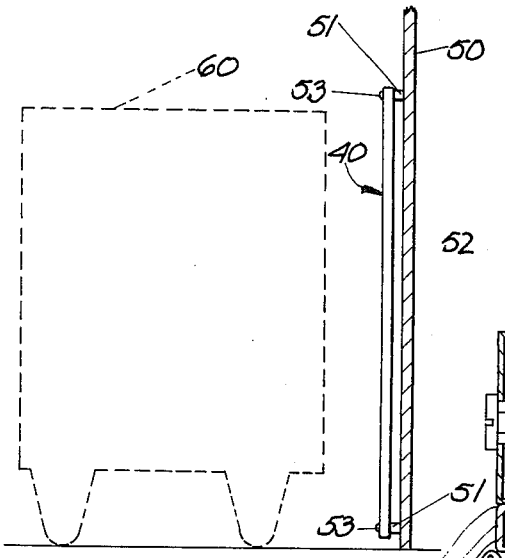
FIG. 7 is a fragmentary side elevation view, partially in cross section, of the protective screen illustrated in FIG. 7 shown in association with a fuel burning stove.
Figure 8:
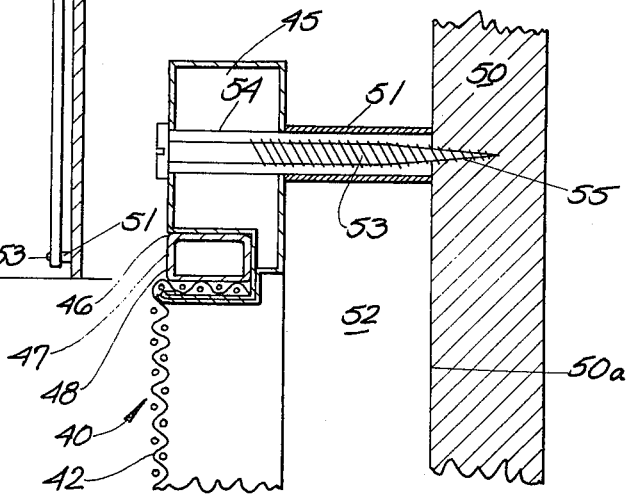
FIG. 8 is a fragmentary cross sectional view taken along section lines 8—8 of FIG. 6.

In FIG. 6–FIG. 8, the inventive principles of the present invention are utilized in connection with a protective screen for reducing heat transmitted from a fuel burning stove or the like to an adjacent structural wall surface. The protective screen, shown generally at 40, comprises a generally rectangular frame 41 enclosing an area corresponding to the area of the wall surface to be protected. Frame 41 supports a mesh-like screen 42 made up of the mesh-like material 7 described hereinabove. In a preferred embodiment, mesh-like screen 42 will be formed of high purity copper strands having thicknesses of about 0.015 inches to 0.018 inches, with about 20–22 strands per inch. The copper screen may be left in its natural state, or painted or anodized to provide an attractive appearance, as required.

Supporting frame 41 is comprised of a pair of vertically positioned parallel spaced frame members 43 joined by parallel spaced horizontal frame members 44. Frame members 43 and 44 may be secured at their adjacent corners by angle-brackets or other means, not shown as is well understood in the art.

In general, supporting frame 41 may be constructed of aluminum, and may be painted or otherwise treated to provide a pleasing appearance. As best shown in the cross sectional view in FIG. 8, each frame member 43 and 44 comprises a hollow generally rectangular shaped channel-like section 45, and a C-shaped channel-like section 46 having one side open as at 47. Mesh-like screen 42 is inserted into channel-like portion 46, and is held in place by an elongated tubular metallic or resilient keeper 48. It will be observed that this construction permits mesh-like screen 42 to be drawn tightly between the supporting frame members to prevent sags or wrinkles.

The protective screen 40 of the present invention also includes means for supporting frame 41 in spaced parallel relationship with an adjoining wall surface shown generally at 50 in FIG. 6–6 FIG. 8. In a preferred embodiment, supporting means comprise hollow elongated spacing members 51 positioned between frame 41 and the adjoining wall surface 50 near the corners of the supporting frame. In general, spacing members 51 will be of sufficient length, for example, 1 inch, to create an air space 52 between the rear surface of mesh-like screen 42 and the inner surface 50*a* of wall 50. This arrangement permits the free passage of ventilating air through the screen to enhance the heat protecting characteristics.

Protective screen 40 may be fastened to the adjoining wall surface by fastening members 53 such as screws or the like, which pass through cooperating aperatures 54 in the upper channel-like portion 45 of frame members 43 and 44. The threaded fasteners continue through tubular spacing members 51, and are fixedly secured to wall 50 as at 55. It will be observed that this method permits the protective screen 40 to be easily attached to an existing wall surface at any location where heat protection is required.

A typical installation of the protective screen of the present invention is illustrated in FIG. 7 in connection with a conventional fuel burning stove or the like 60. In this configuration, protective screen 40 is spaced approximately 1 inch from the adjoining wall 50, and supports a mesh-like screen of sufficient surface area to protect the adjoining wall surface from heat given off by the fuel burning stove. In general, the required surface screen area necessary to protect combustibles within 6 inches of the screen may be calculated from the relationship $1.618^5 \times$contemplated burn area. In other words, it has been found that the surface area of the screen must be no less than approximately 11 times the contemplated burn area associated with the wood burning stove to insure that sufficient heat is directed away from the wall surface to prevent temperature rise which might cause over heating of the adjacent wall surface. That is, with the protective screen 40 of the present invention positioned approximately 1 inch from the adjoining wall surface, and the wood burning stove positioned approximately 6 inches from the protective screen, the surface area of the protective screen must be no less than that designated by the aforementioned relationship to insure safe operating conditions. In this relationship, the contemplated burn area is the heat producing area of the fuel burning stove, which is usually approximately two $ft^2$ for a typical stove.

It will be observed that this arrangement permits the wood burning stove or the like to be positioned much more closely to the adjoining wall surface than is currently possibly with other types of fire protection techniques. The mesh-like screen 42 supported by the frame 41 permits the passage of ventilating air therethrough, but is constructed of a material having a high heat conductivity such that transfer of heat and relatively high temperatures associated with the stove to the adjoining wall is retarded to a relatively great extent.

It will be understood that various changes in the details, materials, steps and arrangements of parts, which have been herein described and illustrated in order to explain the nature of the invention, may be made by those skilled in the art within the principle and scope of the invention as expressed in the appended claims. While for purposes of an exemplary showing, the metallic mesh 7 has been described and illustrated for use in a ventilating wall structure, it will be understood that the principle of the present invention has equal applicability in providing a porous fire stop in any chase or passageway, such as that occupied by heating ducts, plumbing or electrical lines, etc., in order to prevent spread of fire through these areas. For example, the metallic mesh 7 can be installed within the type of ventilating duct work 31 shown in FIG. 3 to prevent this passageway being used as a fire conduit to other enclosed areas.

The embodiments of the invention in which an exclusive property or privilege is claimed are as follows:

1. A protective screen reducing heat transmitted from a stove to an adjacent structural wall surface comprising:

a supporting frame enclosing an area corresponding to the area of the wall surface to be protected adjacent to the stove;

a mesh-like screen supported by said frame, said screen being formed of metallic strands of high purity copper having a thermal conductivity of at least about 0.9 cal-cm-sec/$cm^{2}$-°C., said screen having openings of a size permitting the free passage of ventilating air therethrough but retarding transfer of heat of relatively high temperatures associated with said stove to the adjoining wall surface to a relatively great extent; and means for supporting said frame in spaced parallel relationship with said wall surface so as to create an air space between said screen material and the adjoining wall surface.

2. The protective screen according to claim 1 wherein said screen comprises metallic strands having diameters of about 0.015 inch to 0.018 with about 20–22strands per inch.

3. The protective screen according to claim 1 wherein said supporting means comprises hollow elongated tubular spacing members positioned between said frame and the adjoining wall, and fastening means extending through said frame and said spacing members for securing said protective screen to the wall.

4. The protective screen according to claim 3 wherein said spacing members are dimensioned to create the air space between said screen material and the adjoining wall surface.

5. The protective screen according to claim 1 wherein the surface area of said screen is at least eleven times the contemplated burn area.

* * * * *